US005957227A

United States Patent [19]

Besson et al.

[11] Patent Number: 5,957,227

[45] Date of Patent: Sep. 28, 1999

[54] BLADE-EQUIPPED DRILLING TOOL, INCORPORATING SECONDARY CUTTING EDGES AND PASSAGES DESIGNED FOR THE REMOVAL OF EVACUATED MATERIAL

[75] Inventors: Alain Besson, Saint-Remy-les-Chevreuses, France; Kenneth Blackwood, Victoria, Tex.

[73] Assignees: Total, Puteaux, France; Baker Hughes Incorporated, Houston, Tex.

[21] Appl. No.: 08/974,299

[22] Filed: Nov. 19, 1997

[30] Foreign Application Priority Data

Nov. 20, 1996 [FR] France ..... 96-14143

[51] Int. Cl.[6] ..... E21B 10/18

[52] U.S. Cl. ..... 175/393; 175/431

[58] Field of Search ..... 175/428, 431, 175/432, 399, 393

[56] References Cited

U.S. PATENT DOCUMENTS

| | | | |
|---|---|---|---|
| 3,322,218 | 5/1967 | Hildebrandt . | |
| 4,382,477 | 5/1983 | Barr | 175/432 X |
| 4,471,845 | 9/1984 | Jurgens | 175/431 |
| 4,540,055 | 9/1985 | Drummond et al. . | |
| 4,606,418 | 8/1986 | Thompson . | |
| 4,733,735 | 3/1988 | Barr et al. . | |
| 4,883,132 | 11/1989 | Tibbitts . | |
| 4,887,677 | 12/1989 | Warren et al. . | |
| 4,942,933 | 7/1990 | Barr et al. | 175/431 |
| 5,186,268 | 2/1993 | Clegg | 175/399 |
| 5,199,511 | 4/1993 | Tibbitts et al. . | |
| 5,244,039 | 9/1993 | Newton, Jr. et al. . | |
| 5,531,281 | 7/1996 | Murdock . | |
| 5,590,727 | 1/1997 | Tank et al. | 175/374 |
| 5,720,357 | 2/1998 | Fuller et al. | 175/428 |
| 5,819,860 | 10/1998 | Newton et al. | 175/393 |

FOREIGN PATENT DOCUMENTS

| | | |
|---|---|---|
| 1 039 889 | 10/1953 | France . |
| 2 047 308 | 11/1980 | United Kingdom . |
| 2 183 693 | 6/1987 | United Kingdom . |
| 2 298 666 | 9/1996 | United Kingdom . |

*Primary Examiner*—Frank Tsay
*Attorney, Agent, or Firm*—Sughrue, Mion, Zinn, Macpeak & Seas, PLLC

[57] ABSTRACT

A drilling tool has several blades 16 each defining an outside wall 20 and two side walls 22, 24. The blades are separated by recesses 18, primary bits 28 are located along the outside wall of the blades, and secondary or backup bits 40 are attached behind the primary bits in relation to the direction of travel (f) of the tool. Each of the blades defines at least one divergent tunnel or channel 30 having small entry opening 32 located in the outside wall of the blade, behind the primary bits, and a larger exit opening 34 located on the rear side of the blade. The secondary bits are mounted at the rear edge of the entry opening, and the channel serves to discharge material excavated by them.

7 Claims, 1 Drawing Sheet

BLADE-EQUIPPED DRILLING TOOL, INCORPORATING SECONDARY CUTTING EDGES AND PASSAGES DESIGNED FOR THE REMOVAL OF EVACUATED MATERIAL

BACKGROUND OF THE INVENTION

The present invention concerns a drilling tool incorporating blades fitted with secondary cutting edges and a system making it possible to remove the material excavated by these secondary cutting edges.

The problem which inspired the invention will be explained with reference to FIGS. 1 and 2, which show, respectively, a perspective view of a drilling tool incorporating conventional blades and secondary cutting edges, and an enlarged transverse cross-section along line II—II in FIG 1.

The cutting tool 10 illustrated in FIG. 1 comprises a head 12 fitted with a tubular threaded connector, which is used to mount the tool on a drive tube train (not shown). The tool may be driven in rotation around its axis with a slight downward helicoidal motion, in the direction of the arrow f. Multiple projecting ribs, or blades, 16 separated by grooves 18 are formed around the head. Each blade has an outer face 20 and two lateral faces 22, 24 which extend downward toward the bottom of the grooves bordering the blade.

The driving edge 26 of each blade, that is, the edge which first encounters the deposit, has embedded along it a series of primary cutting edges 28 of any conventional type, for example cutting edges formed as inserts made of natural or synthetic diamond or of PDC, which are fastened to the blade.

Back-up, or secondary, cutting edges 40 positioned in at least the cutting face area of the tool are fastened to the upper face of the blades and to the rear of the primary cutting edges, as determined by the direction of travel of the blade.

When in operation, the primary cutting edges break up the deposit, and the resulting excavated material is carried away along he grooves 18. But, because of the helicoidal movement of the tool inside the drill hole, the secondary cutting edges may come in contact with areas of the deposits which have not previously been broken up by the primary cutting edges. The secondary cutting edges then produce debris which, because no path for removal exists, accumulates in the spaces 29 between the second and primary cutting edges. The result is the localized packing of material and a significant loss of tool efficiency.

This packing tendency is exacerbated when the tool is used to drill soft deposits or those exhibiting a high degree of plasticity, since these deposits tend to warp plastically to the inside of the drill hole after the primary cutting edges have passed. The secondary cutting edges dig into the deformed areas and, here again, produce excavated material which accumulates in the spaces 29.

Until now, to avoid packing in the spaces 29, normal practice entailed dispersing the excavated material using jets of liquid that are emitted under high pressure through nozzles positioned in said spaces. However, in practice, the use of this process to carry away the material gives mediocre results because of the narrowness of the spaces.

SUMMARY OF THE INVENTION

The present invention represents an attempt to solve this problem and, therefore, it concerns a drilling tool of the type previously mentioned which is not subject to packing, without, however, being required to use a hydraulic irrigation system.

To this end, the drilling tool according to the invention is characterized by the fact that each of the blades incorporates at least one diffusing channel whose inlet orifice has a relatively small section located at the top of the blade and behind the primary cutting edges borne by said blade, as determined by the direction travel of the tool, and an outlet orifice having a relatively large section located within the rear face of the blade, the secondary cutting edges being fastened to the rear edge of the inlet orifice of said channel, so that the material excavated by the secondary cutting edges is carried away through said channel to the adjacent groove located to the rear of the blade.

Since the channel inlet opens immediately in front of the secondary cutting edges, the material excavated by these secondary cutting edges in the aforementioned space is carried away as it is produced through the channel until it reaches the groove located behind the corresponding blade. The flow of the excavated material occurs by virtue of natural mechanical extrusion and in the absence of hydraulic irrigation, the new, excavated material pushing the previously-produced material.

Removal of the material can be improved by positioning, within the aforementioned spaces, nozzles which emit high-pressure jets of liquid. These jets attack the debris and drive it toward the channels.

BRIEF DESCRIPTION OF THE FIGURES

The invention will now be described in detail with reference to the attached drawings, in which.

DETAILED DESCRIPTION OF THE PREFERRED EMBODIMENTS

Figure 1:
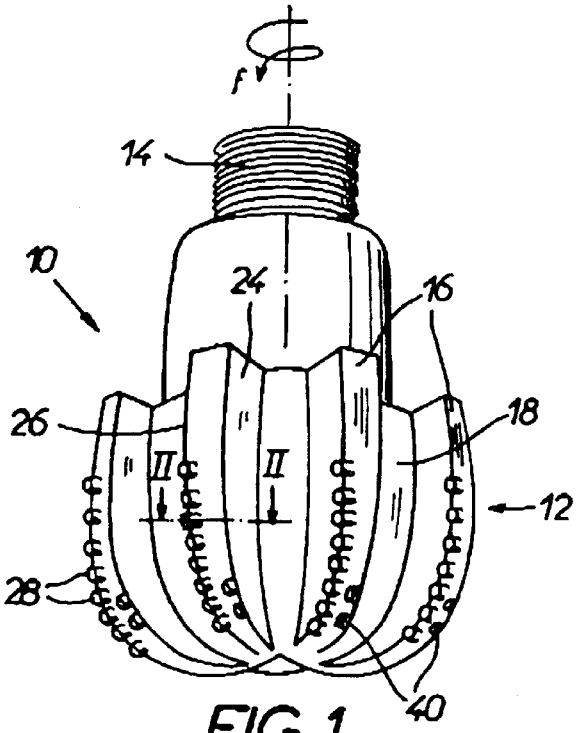
FIG. 1 is a perspective view of a conventional drilling tool incorporating secondary cutting edges.
Figure 2:
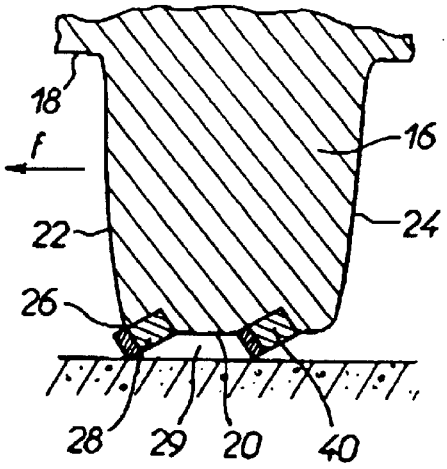
FIG. 2 is an enlarged transverse cross-section along line II—II in FIG. 1.

The following description will focus only on the components of the tool that are new according to the invention, the components that are the same as those of the tool in FIGS. 1 and 2 being designated by the same reference numbers. Each blade 16 of the tool incorporates at least one diffusing channel 30 whose section increases as it extends from an inlet orifice 32, which has a relatively small section and is located on the outer face 20 of the blade and to the rear of the primary cutting edges 28 as determined by the direction of travel f of the blade, to an outlet orifice 34 having a relatively large section which opens into the rear face 24 of the blade. This configuration thus creates a portion of the blade forming a bridge 38 which straddles the channel.

Figure 3:
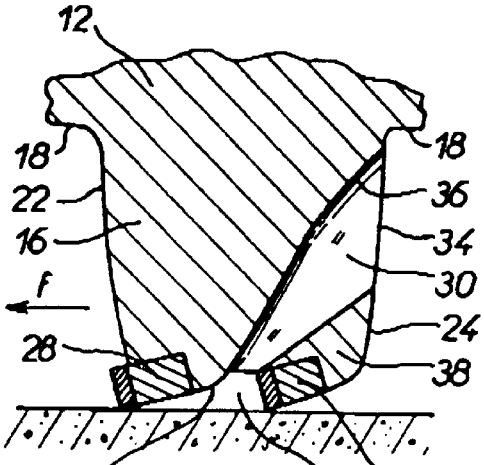
FIG. 3 is a cross-section, similar to FIG. 2, of a drilling tool according to a first embodiment of the invention.
Figure 4:
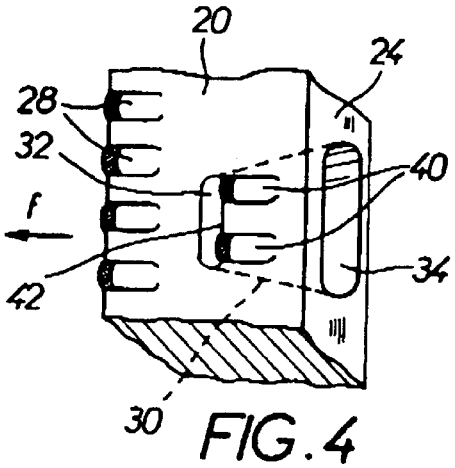
FIG. 4 illustrates an enlarged detail of the tool according to the invention, in which the secondary cutting edges are placed in a staggered configuration in relation to the primary cutting edges.

As illustrated in FIGS. 3 and 4, the channel section widens both in height and width as it extends from the inlet orifice 32 to the outlet orifice 34. The upper wall 36 of the channel (shown in FIG. 3) slopes toward the groove 18 located to the rear of the blade 16.

According to the invention, secondary cutting edges 40 are fastened to the rear edge 42 of the inlet orifice 32.

Operation of the tool according to the invention will now be explained with reference to FIG. 3 for a single blade, it being understood that this explanation applies to each of the blades.

The material excavated by the primary cutting edges 28 falls directly into the groove 18 shown on the left in FIG. 3, while the material excavated by the secondary cutting edges 40 is automatically carried away through the channel 30 to the right-hand groove by natural extrusion, the new material pushing the debris previously produced. In the grooves, the material is carried away by the washing fluid from the tool.

Flow within the channel occurs freely, since this channel widens as it extends from the inlet orifice to the outlet orifice. Removal flow is also promoted by the slope of the upper wall 36 of the channel toward the bottom of the groove, since the material travels accordingly in the proper direction through the orifice 32, without having to be deflected in order to travel in the direction of the channel.

As a result, no packing occurs in the spaces 29 between the primary and the secondary cutting edges. The drilling tool according to the invention can thus be used to drill in soft or viscous deposits.

It will be noted that, in the embodiment illustrated in FIG. 4, the secondary cutting edges 40 are arranged in staggered rows in relation to the primary cutting edges 28. Given that the tool travels in the direction of the arrow f with a slight downward helicoidal motion, it will be understood that, in this case, the secondary cutting edges will follow fairly precisely the path of the primary cutting edges which precede them, and that they will thus travel again over the same areas of the deposit that were previously broken up by the primary cutting edges. As a result, the secondary cutting edges will, therefore, "pick up" virtually no material, and the tool will possess a relatively fast forward speed.

Figure 5:
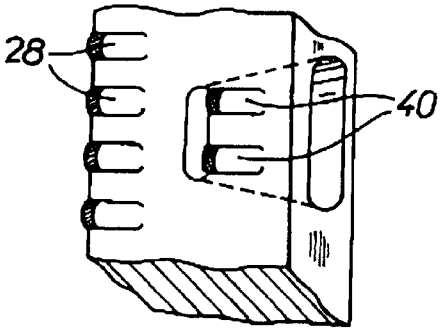
FIG. 5 is a view similar to FIG. 4, but in which the secondary cutting edges are arranged in the same transverse planes in which the primary cutting edges lie.

In the embodiment in FIG. 5, on the other hand, the secondary cutting edges 40 are positioned precisely to the rear of the primary cutting edges 28, that is, on the same transverse planes which contain these primary cutting edges. As a result of the helicoidal motion of the tool, the secondary cutting edges will follow paths distinct from those of the primary cutting edges, and will dig into areas of the deposit which have not previously been broken up by the primary cutting edges. The speed of forward travel of the tool will thus be lower than in the preceding embodiment.

Figure 6:
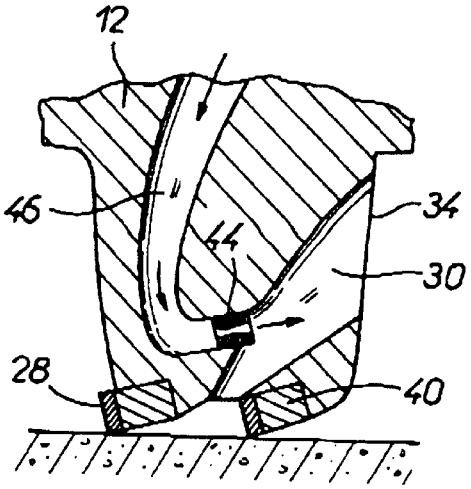
FIG. 6 is a cross-section of a variant of the tool, in which the channels are fitted with nozzles.

In the embodiment in FIG. 6, one or several nozzles 44 used to emit high-pressure jets of water are fastened in each channel 30. The nozzles are fed by a liquid, which reaches the nozzle through a duct 46. The nozzles are mounted in one of the walls of the channel 30 and are positioned in such a way that the hydraulic jets they emit carry the material toward the outlet orifice 34 of the channel.

We claim:

1. A drilling tool incorporating secondary cutting edges, of the type comprising a head (12) on which is formed a multiplicity of ribs, or blades (16), each of which comprises an outer wall (20) and two lateral faces (22, 24), said blades being separated by grooves (18), primary cutting edges (28) being embedded along the outer walls of the blades and secondary, or back-up, cutting edges (40) being fastened to the rear of the primary cutting edges, as determined by the direction of travel (f) of the tool, wherein each of the blades incorporates at least one diffusing channel (30) having an inlet orifice (32) of a relatively small section located on the outer wall of the blade and to the rear of the primary cutting edges borne by said blade as determined by the direction of the travel of the tool, and an outlet orifice (34) having a relatively large section located in a rear lateral face (24) of the blade, the secondary cutting edges being fastened to a rear edge (42) of the inlet orifice of said channel, so that debris produced by the secondary cutting edges in spaces (29) between the secondary and the primary cutting edges is carried through said channel to an adjacent groove located to the rear of the blade.

2. The drilling tool according to claim 1, wherein the channel has a section which widens uniformly as it extends from the inlet orifice to the outlet orifice thereof.

3. The drilling tool according to claim 2, wherein the channel section widens both longitudinally and transversely.

4. The drilling tool according to claim 1, wherein an the upper wall of the channel slopes toward the bottom of the groove located to the rear of the blade.

5. The drilling tool according to claim 1, wherein the secondary cutting edges are arranged in a staggered configuration in relation to the primary cutting edges and with respect to the direction of the rotation of the tool.

6. The drilling tool according to claim 1, wherein the secondary cutting edges are positioned to the rear of the primary cutting edges and on the same transverse planes as the latter, as determined by the direction of rotation of the tool.

7. The drilling tool according to claim 1, wherein each channel houses at least one nozzle that can emit high-pressure hydraulic jets, said nozzles being positioned in such a way that the jets drive the material excavated by the secondary cutting edges toward the outlet orifice of the channel.

* * * * *